US010730102B2

(12) United States Patent
Okabe et al.

(10) Patent No.: US 10,730,102 B2
(45) Date of Patent: Aug. 4, 2020

(54) APPARATUS FOR MANUFACTURING METAL THIN STRIP

(71) Applicant: JFE STEEL CORPORATION, Tokyo (JP)

(72) Inventors: Seiji Okabe, Tokyo (JP); Takeshi Imamura, Tokyo (JP); Shigehiro Takajo, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 299 days.

(21) Appl. No.: 15/750,133

(22) PCT Filed: Jul. 20, 2016

(86) PCT No.: PCT/JP2016/071213
§ 371 (c)(1),
(2) Date: Feb. 2, 2018

(87) PCT Pub. No.: WO2017/022480
PCT Pub. Date: Feb. 9, 2017

(65) Prior Publication Data

US 2018/0221941 A1 Aug. 9, 2018

(30) Foreign Application Priority Data

Aug. 5, 2015 (JP) ..... 2015-154913

(51) Int. Cl.
*B22D 11/06* (2006.01)

(52) U.S. Cl.
CPC ..... *B22D 11/0665* (2013.01); *B22D 11/0611* (2013.01); *B22D 11/0697* (2013.01)

(58) Field of Classification Search
CPC . B22D 11/06; B22D 11/0611; B22D 11/0665; B22D 11/0697
(Continued)

(56) References Cited

FOREIGN PATENT DOCUMENTS

CN 2734373 Y 10/2005
CN 102271837 A 12/2011
(Continued)

OTHER PUBLICATIONS

Oct. 11, 2016 International Search Report issued in International Patent Application No. PCT/JP2016/071213.
(Continued)

*Primary Examiner* — Kevin P Kerns
(74) *Attorney, Agent, or Firm* — Oliff PLC

(57) ABSTRACT

A single roll type apparatus for manufacturing a metal thin strip by injecting a molten metal onto an outer peripheral face of a cooling roll rotating at a high speed and rapidly solidifying it to manufacture a metal thin strip, wherein an airflow blocking device for blocking the airflow along the surface of the cooling roll is provided at an upstream side of a molten metal injection nozzle for injecting the molten metal in a rotation direction of the cooling roll, and a carbon dioxide gas injection nozzle for forming a flow of carbon dioxide gas on an outer peripheral surface of the cooling roll between the airflow blocking device and the molten metal injection nozzle or forming a carbon dioxide atmosphere on the surface of the cooling roll between the airflow blocking device and the molten metal injection nozzle is disposed, and a foreign material removal device for removing foreign material attached to the surface of the cooling roll is disposed at an upstream side of the airflow blocking device in the rotation direction of the cooling roll, whereby a metal thin strip having a good surface quality can be manufactured stably even in the continuous operation for a long time.

10 Claims, 2 Drawing Sheets

(58) Field of Classification Search
USPC ..... 164/158, 423, 427, 429
See application file for complete search history.

(56) References Cited

FOREIGN PATENT DOCUMENTS

| | | | |
|---|---|---|---|
| EP | 0145933 | A1 | 6/1985 |
| JP | H04-356336 | A | 12/1992 |
| JP | H06-292950 | A | 10/1994 |
| JP | H08-019834 | A | 1/1996 |
| JP | H09-216036 | A | 8/1997 |
| JP | H09-253804 | A | 9/1997 |
| JP | H11-277187 | A | 10/1999 |
| KR | 20030053404 | A | 6/2003 |
| RU | 2484920 | C1 | 6/2013 |
| SU | 1013088 | A1 | 4/1983 |

OTHER PUBLICATIONS

Dec. 19, 2019 Office Action issued in Korean Patent Application No. 10-2019-7036555.
Mar. 4, 2019 Office Action issued in Chinese Patent Application No. 201680045837.5.
May 8, 2018 Office Action issued in Japan Patent Application No. 2015-154913.
Apr. 18, 2018 Extended European Search Report issued in Patent Application No. 16832759.1.
Apr. 10, 2019 Office Action issued in Korean Patent Application No. 10-2018-7003362.
Oct. 17, 2019 Office Action issued in Korean Patent Applicatin No. 2018-7003362.
Nov. 1, 2018 Office Action issued in Russian Patent Application No. 2018107724.
Apr. 24, 2020 Office Action issued in Chinese Patent Application No. 201680045837.5.

APPARATUS FOR MANUFACTURING METAL THIN STRIP

TECHNICAL FIELD

This invention relates to an apparatus for manufacturing a metal thin strip, and more particularly to a single roll type apparatus for manufacturing a metal thin strip, which manufactures a metal thin strip having an excellent surface property.

RELATED ART

As a method of directly manufacturing a metal thin strip from a molten metal, there is known a single roll method wherein a molten metal is supplied onto an outer peripheral face of a single cooling roll rotating at a high speed (hereinafter called as "roll surface") through a nozzle and solidified by rapid cooling while forming a paddle to manufacture a metal thin strip. In such a direct strip-making technique, it is the most important issue how to obtain a thin strip having a thickness uniformity and an excellent surface property. Especially, when the metal thin strips are used at a laminated state as in amorphous alloy thin strips used as an iron core material for transformers, the surface property is the most important control item because it largely acts on the characteristics of the transformer.

The deterioration of the surface property in the metal thin strip is caused due to the fact that an air boundary layer is produced on the roll surface associated with the rotation of the cooling roll to generate airflow along the roll surface and air is caught and closed between the molten metal injected onto the roll surface and the cooling roll by such an airflow to form a pocket-like dent.

As a technique for preventing the above deterioration of the surface property is known a method of making a molten metal injecting portion into vacuum or a carbon monoxide combustion atmosphere or a carbon dioxide atmosphere. In particular, the method of making into the carbon dioxide atmosphere does not cause a problem in safety such as explosion, intoxication or the like and has a merit of easily introducing into a large-scale equipment. As the method of making the carbon dioxide atmosphere, there is a technique of blowing carbon dioxide onto the molten metal injecting portion. In this technique, however, there is a risk that a temperature of a nozzle for injecting the molten metal is lowered to cause nozzle clogging, or the surface of the molten metal flow becomes unstable due to the pressure change of carbon dioxide blown.

Patent Document 1 discloses a method of covering the molten metal injecting portion with a chamber to make into a carbon dioxide atmosphere. Patent Document 2 discloses a method wherein a carbon blade is arranged at an upstream side from an injecting position of the molten metal in the rotation direction of the roll while contacting with a bus bar of the roll surface and carbon dioxide gas (which may be represented by "$CO_2$ gas" hereinafter) is injected toward the roll surface along the surface of the molten metal side (downstream side) of the carbon blade to keep carbon dioxide atmosphere in the vicinity of the roll surface at the upstream side from the injecting position of the molten metal.

PRIOR ART DOCUMENTS

Patent Documents

Patent Document 1: JP-A-H04-356336
Patent Document 2: JP-A-H06-292950

SUMMARY OF THE INVENTION

Task to be Solved by the Invention

However, the method disclosed in Patent Document 1 has problems that a large-scale apparatus is needed and the atmosphere control becomes complicated. Also, the method disclosed in Patent Document 2 has an effect of improving the surface property to a certain extent but causes a new problem that when the system is continuously operated for a long time, foreign material such as dust, broken pieces of the thin strip and so on are gradually stored between the carbon blade and the cooling roll, and the surface of the cooling roll is damaged by the foreign material to rather deteriorate the surface property of the thin strip.

The invention is made in consideration of the above problems of the conventional techniques and is to provide an apparatus for manufacturing a metal thin strip which is capable of suppressing air catching between the surface of the cooling roll and the molten metal to reduce surface roughness of the metal thin strip and improve the surface quality and stably keeping a good surface quality even in a continuous operation for a long time.

Solution for Task

The inventors have made various studies for solving the above task. As a result, it has been found that the good surface quality can be stably maintained even in a manufacture for a long time by providing an airflow blocking device for blocking the airflow along the surface of a cooling roll at an upstream side of a molten metal injection nozzle for injecting a molten metal onto a surface of the cooling roll, a carbon dioxide gas injection nozzle for forming a flow of carbon dioxide gas at an immediately downstream side of the airflow blocking device, and a foreign material removal device for removing foreign material attached to the roll surface at an upstream side of the airflow blocking device. Thus, the invention has been accomplished.

That is, the invention is a single roll type apparatus for manufacturing a metal thin strip by injecting a molten metal onto an outer peripheral face of a cooling roll rotating at a high speed and rapidly solidifying the metal to manufacture a metal thin strip, characterized in that an airflow blocking device for blocking the airflow along the surface of the cooling roll is provided at an upstream side of a molten metal injection nozzle for injecting the molten metal in a rotation direction of the cooling roll, and a carbon dioxide gas injection nozzle for forming a flow of carbon dioxide gas on the outer peripheral surface of the cooling roll or forming a carbon dioxide atmosphere on the surface of the cooling roll is disposed between the airflow blocking device and the molten metal injection nozzle, and a foreign material removal device for removing foreign material attached to the surface of the cooling roll is disposed at an upstream side of the airflow blocking device in the rotation direction of the cooling roll.

In the apparatus for manufacturing a metal thin strip according to the invention, the foreign material removal device is disposed within a range of 600 mm at the upstream side in the rotation direction of the cooling roll with respect to the airflow blocking device.

In the apparatus for manufacturing a metal thin strip according to the invention, the foreign material removal device is a permanent magnet or an electric magnet disposed in non-contact with the surface of the cooling roll.

In the apparatus for manufacturing a metal thin strip according to the invention, the foreign material removal device is a gas injection device injecting a gas onto the surface of the cooling roll.

In the apparatus for manufacturing a metal thin strip according to the invention, the foreign material removal device contacts with the surface of the cooling roll for removing foreign material.

In the apparatus for manufacturing a metal thin strip according to the invention, the airflow blocking device is disposed in contact with the surface of the cooling roll or at a gap of not more than 2 mm to the surface of the cooling roll.

In the apparatus for manufacturing a metal thin strip according to the invention, the airflow blocking device is disposed within a range of 300 mm at the upstream side in the rotation direction of the cooling roll with respect to the molten metal injection nozzle for injecting the molten metal.

In the apparatus for manufacturing a metal thin strip according to the invention, the airflow blocking device is made from a material softer than the surface of the cooling roll.

In the apparatus for manufacturing a metal thin strip according to the invention, the carbon dioxide gas injection nozzle injects the carbon dioxide gas toward a portion of the airflow blocking device contacting with the surface of the roll and along a surface at a downstream side of the airflow blocking device in the rotation direction of the roll.

In the apparatus for manufacturing a metal thin strip according to the invention, the carbon dioxide gas injection nozzle injects the carbon dioxide gas toward the surface of the roll between the molten metal injection nozzle and the airflow blocking device.

Effect of the Invention

According to the apparatus of the invention, the damage of the cooling roll surface by the foreign material can be prevented even in a continuous operation for a long time, so that the surface property of the metal thin strip can be maintained at a good state, and hence the invention largely contributes to not only the improvement of the quality but also the stability of the productivity.

EMBODIMENTS FOR CARRYING OUT THE INVENTION

Figure 1:
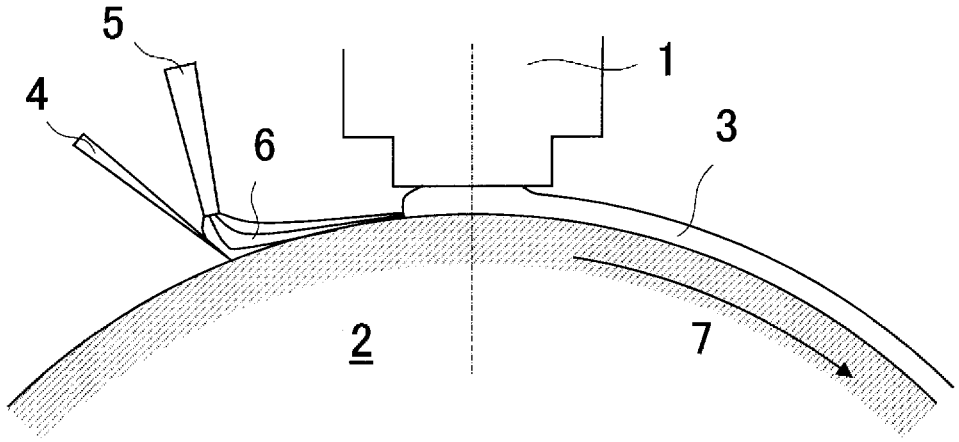
FIG. 1 is a side view of the conventional apparatus for manufacturing a metal thin strip.

FIG. 1 schematically shows the conventional apparatus for manufacturing a metal thin strip, which is disclosed in Patent Document 2. In this apparatus, a cooling roll 2 is rotated at a high speed in a direction of an arrow 7, and a molten metal (melt) 3 injected from a molten metal injection nozzle 1 onto an outer peripheral face of the cooling roll (roll surface) is rapidly cooled to form a thin strip. At an upstream side of the molten metal injection nozzle 1 injecting the molten metal onto the roll surface in the rotation direction of the roll, there is disposed a carbon blade 4 in contact with the surface of the cooling roll, which acts as an airflow blocking device for blocking an airflow formed on the roll surface by a boundary layer associated with the rotation of the cooling roll and flown from the upstream side toward the downstream side in the rotation direction of the roll.

Between the carbon blade 4 and the molten metal injection nozzle 1 is disposed a carbon dioxide gas injection nozzle 5 injecting the carbon dioxide gas toward the roll surface. The carbon dioxide gas injected onto the roll surface forms a new flow 6 including a boundary layer on the roll surface between the carbon blade 4 and the molten metal injection nozzle 1 and arrives at the molten metal 3 or forms a carbon dioxide atmosphere on the roll surface (neighborhood) between the carbon blade 4 and the molten metal injection nozzle 1, which suppresses surface oscillation of molten metal flow and prevents catching of air between the molten metal and the roll to improve the surface quality of the metal thin strip.

In the apparatus for manufacturing the metal thin strip shown in FIG. 1, however, foreign material such as dust floating in the atmosphere, powder formed by solidifying droplets of the molten metal, fine broken pieces of the metal thin strip and so on is adhered and transferred to the surface of the cooling roll or transferred with an airflow resulted from the boundary layer on the surface of the cooling roll and gradually stored between the carbon blade 4 and the cooling roll surface during the continuous operation for a long time.

In general, the cooling roll is made from a copper alloy having a high thermal conductivity and is low in the hardness, so that it is liable to easily cause flaws on the surface by hard foreign material. As a result, the flaws are transferred to the metal thin strip to cause surface defects or large depressions or holes are caused in the metal thin strip by air enclosed in the flaw portions, which are badly exerted on the surface quality of the metal thin strip. Also, when the flaw is caused in the roll surface, it is necessary that the manufacture of the metal thin strip is interrupted to take care of the cooling roll surface (grinding) or replace with a new cooling roll, which remarkably decreases the productivity.

In the apparatus for manufacturing the metal thin strip according to the invention, therefore, a foreign material removal device 8 is disposed at an upstream side of the carbon blade 4 in the rotation direction of the roll and close to the carbon blade 4, whereby the foreign material attached to the surface of the cooling roll or transferred with the airflow on the surface of the cooling roll are removed to suppress deposition of the foreign material between the carbon blade 4 and the surface of the cooling roll to thereby prevent damaging of the cooling roll surface. That is, the apparatus for manufacturing the metal thin strip according to the invention can maintain a good surface quality stably even in the continuous operation for a long time by combining the conventional airflow blocking device and carbon dioxide gas injection nozzle of the conventional techniques with the foreign material removal device.

Here, the foreign material removal device is necessary to be disposed at the upstream side with respect to the airflow blocking device in the rotation direction of the roll. However, when the distance to the airflow blocking device is too separated even at the upstream side, there is a fear of reattachment of the foreign material suspended in an operating space such as dusts or the like to the roll surface, so that the foreign material removal device is preferable to be disposed within 600 mm at the upstream side with respect to the airflow blocking device in the rotation direction of the cooling roll. It is more preferably within 200 mm, further preferably within 100 mm.

As the foreign material removal device are considered two types, i.e. a device type removing the foreign material on the roll surface without contacting with the roll and another device type removing the foreign material physically (mechanically) in contact with the roll. Either of these types may be used as long as the foreign material attached to the roll surface or transferred with airflow on the roll surface can be removed.

As the former foreign material removal device for removing the foreign material without contacting with the roll, for example, there is a device in which a rare-earth magnet or an electric magnet producing a strong magnetic field is disposed close to the roll surface and the foreign material is removed by sucking with the magnetic force. This device utilizes adsorption of the foreign material with the magnet because the great mass of the foreign material are iron powder formed by solidification of molten metal droplets, broken pieces of the metal thin strip, iron-based dusts generated from the manufacturing apparatus and so on. Moreover, the feature that the surface of the cooling roll is non-magnetic (copper alloy) advantageously acts to the utilization of this device because the magnet as the foreign material removal device is not adsorbed to the surface of the cooling roll.

As another foreign material removal device for removing the foreign material without contacting with the roll, a gas injection type device wherein the foreign material is removed by a gas jet which blows a gaseous body (gas) onto the roll surface at a high speed is effective. This device blows out the foreign material by blowing clean air containing no oil, water, dust or the like, a nitrogen gas, an argon gas, a carbon dioxide gas or the like at a high speed through a nozzle close to the roll surface, so that it is an effective means for foreign material not removed by the magnetic force.

As the latter foreign material removal device for removing the foreign material in contact with the roll, there is a device contacting with the surface of the cooling roll to remove the foreign material mechanically and physically. Moreover, the form of the portion contacting with the roll surface may take any of blade type, brush type, roll type, plate (sheet) type, block type, belt type and so on as long as the foreign material can be removed mechanically and physically.

Also, the material of the foreign material removal device, especially the material of the portion contacting with the roll surface is preferably softer than that of the roll surface similarly in the airflow blocking device described later, from a viewpoint of preventing the roll surface from damaging. For instance, a cloth such as felt, nonwoven fabric, gauze or the like, carbon, resin, synthetic rubber and so on can be preferably used. However, when a material does not damage the roll surface (for example, when a blade having a good elasticity is pushed at a weak pressure), it may be harder than the roll surface.

When using the foreign material removal device of the type removing the foreign material in contact with the roll, in order not to fasten the foreign material caught by the foreign material removal device to one place, it is preferable that, for example, in the case of the blade type, plate type, belt type or block type, the widthwise position of the metal thin strip is moved continuously or periodically, while, in the case of the roll type, it is always rotated or periodically rotated at a low speed to remove the foreign material or change the position of the foreign material.

Figure 2:
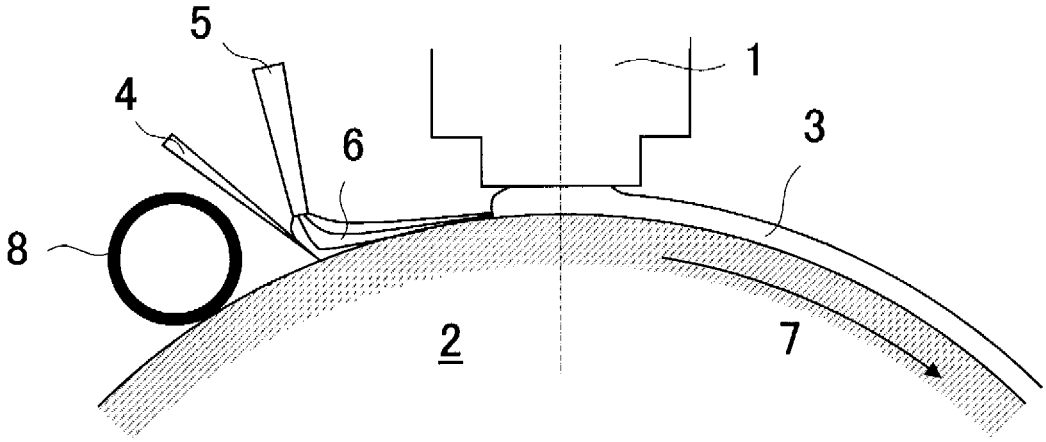
FIG. 2 is a side view illustrating an embodiment of the apparatus for manufacturing a metal thin strip according to the invention.
Figure 3:
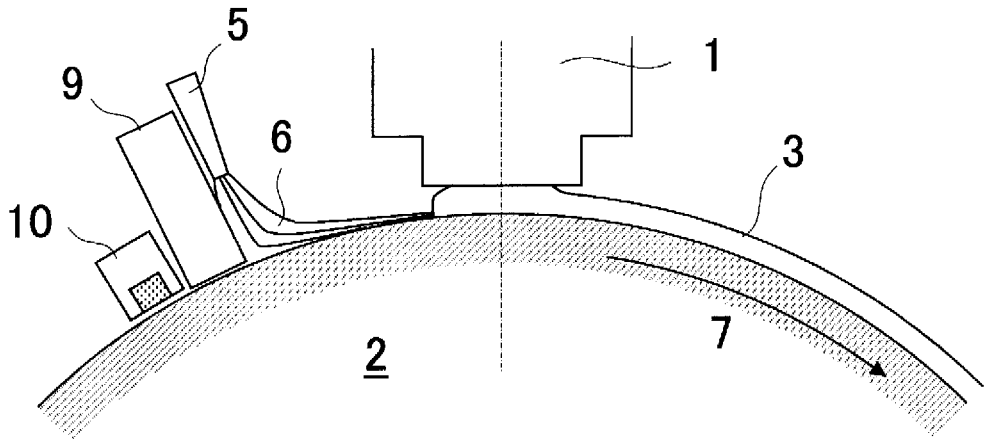
FIG. 3 is a side view illustrating another embodiment of the apparatus for manufacturing a metal thin strip according to the invention.
Figure 4:
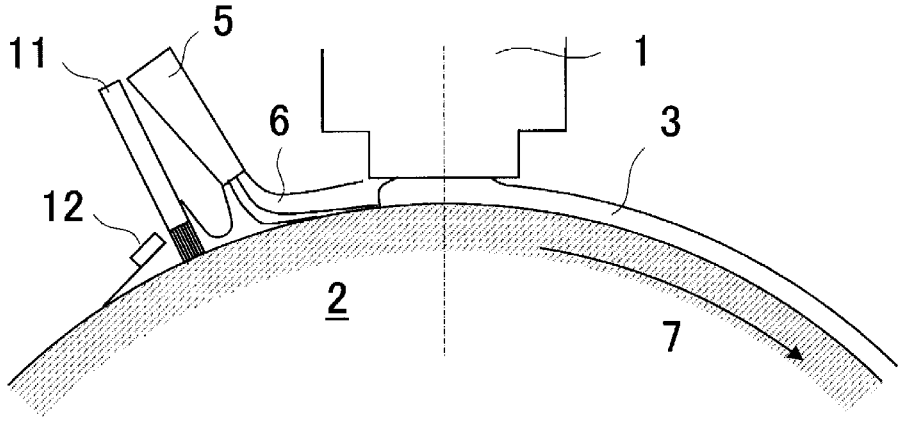
FIG. 4 is a side view illustrating the other embodiment of the apparatus for manufacturing a metal thin strip according to the invention.

FIGS. 2-4 show examples of the apparatus for manufacturing the metal thin strip according to the invention. FIG. 2 is an example that a felt roll 8 formed by winding a felt pad onto a roll is arranged as a foreign material removal device in the apparatus for manufacturing the metal thin strip of FIG. 1. FIG. 3 is an example of arranging a rare-earth magnet 10 close to the roll surface as a foreign material removal device. FIG. 4 is an example of arranging a doctor blade 12 as a foreign material removal device.

Next, an airflow blocking device in the apparatus for manufacturing the metal thin strip according to the invention will be described.

In the apparatus for manufacturing the metal thin strip according to the invention, the airflow blocking device is preferably arranged in contact with the roll surface or close to the roll surface for blocking an airflow formed by a boundary layer on the surface of the rotating cooling roll along the roll surface. Moreover, when the airflow blocking device is arranged close to the roll surface, a gap between the roll surface and the airflow blocking device is preferably not more than 2 mm from a viewpoint of blocking the airflow by the boundary layer effectively. It is more preferably not more than 1 mm, further preferably not more than 0.5 mm.

Here, the position of arranging the airflow blocking device is preferable to be within 300 mm from a position of arranging the molten metal injection nozzle for injecting the molten metal to the surface of the cooling roll toward the upstream side in the rotation direction of the roll. When the position exceeds 300 mm, an airflow is again formed on the roll surface. Moreover, it is more preferably within 200 mm, further preferably within 100 mm.

Also, the width of the airflow blocking device (length in the body length direction of the cooling roll) is preferably not less than a width of the metal thin strip from a viewpoint of suppressing a bad influence of airflow flowing along the surface of the cooling roll upon the metal thin strip, and is more preferably not less than a body length of the cooling roll.

The form of the airflow blocking device may be any of blade form, plate (sheet) form, block form, brush form, roll form and so on, as long as it can block the airflow. Also, the airflow blocking device is not necessary to be one body as long as the same effect can be obtained and may be divided in plural parts in the widthwise direction and combined.

The material of the airflow blocking device, particularly the material of a portion contacting with the roll surface is preferably softer that of the roll surface in order not to cause flaws on the surface of the cooling roll. Also, when the airflow blocking device is arranged in contact with the roll surface, it is preferable to have an elasticity and be excellent in the slide ability, wear resistance, and in addition, heat resistance from a viewpoint of prolonging a service life. Considering them, carbon, resin, synthetic rubber and a cloth such as felt, nonwoven fabric or the like are preferable as the material of the airflow blocking device.

Moreover, FIG. 2 shows an example of using a carbon blade as the airflow blocking device similarly in the case of FIG. 1, and FIG. 3 shows an example of using a block made from a fluorine resin as the airflow blocking device 9, and FIG. 4 shows an example of using a brush provided with a top portion made from aramid fibers as the airflow blocking device 11.

Then, a carbon dioxide gas injection nozzle in the apparatus for manufacturing the metal thin strip according to the invention will be described.

In the carbon dioxide gas injection nozzle according to the invention, carbon dioxide gas is injected between the airflow blocking device and the molten metal injection nozzle to form a flow of carbon dioxide gas on the outer peripheral face of the cooling roll between the airflow blocking device and the molten metal injection nozzle or to form a carbon dioxide atmosphere on the roll surface (vicinity) between the airflow blocking device and the molten metal injection nozzle, which suppresses surface oscillation of molten metal flow and prevents catching of air between the molten metal and the roll to improve the surface quality of the metal thin strip.

In order to form the flow of the carbon dioxide gas on the outer peripheral face of the cooling roll between the airflow blocking device and the molten metal injection nozzle as mentioned above, it is preferable to inject the carbon dioxide gas from the carbon dioxide gas injection nozzle toward a portion of the airflow blocking device contacting with the roll surface and along the surface at the downstream side of the airflow blocking device in the rotation direction of the roll.

In order to form the carbon dioxide atmosphere on the roll surface (vicinity) between the airflow blocking device and the molten metal injection nozzle as mentioned above, it is preferable to inject a large amount of carbon dioxide gas from the carbon dioxide gas injection nozzle toward the roll surface between the molten metal injection nozzle and the airflow blocking device. Here, the large amount means an amount capable of replacing air in the vicinity of the roll surface at least between the airflow blocking device and the molten metal injection nozzle with carbon dioxide substantially completely.

Moreover, FIGS. 2 and 3 are cases that carbon dioxide gas is injected from the carbon dioxide gas injection nozzle toward a portion of the carbon blade (airflow blocking device) contacting with the roll surface and along the surface at the downstream side of the carbon blade in the rotation direction of the roll to form a new flow of carbon dioxide gas on the roll surface between the carbon blade and the molten metal injection nozzle along the roll surface and arrive such a flow at the injected portion of the molten metal similarly in FIG. 1. Further, FIG. 4 shows a case that a large amount of carbon dioxide gas is injected from the carbon dioxide gas injection nozzle toward the roll surface between the brush made from aramid fibers (airflow blocking device) and the molten metal injection nozzle to form carbon dioxide atmosphere in the vicinity of the roll surface between the brush made from aramid fibers and the molten metal injection nozzle.

EXAMPLE

In a single roll type apparatus for manufacturing a metal thin strip provided with an airflow blocking device for blocking airflow on a surface of a cooling roll, a carbon dioxide gas injection nozzle between the airflow blocking device and a molten metal injection nozzle, and a foreign material removal device at an upstream side of the airflow blocking device in a rotation direction of a roll, there is conducted an experiment of continuously manufacturing an amorphous metal thin strip as an iron core for a transformer having a chemical composition of Fe-3 mass % B-5.3 mass % Si and a thickness of 25 μm for 30 minutes.

Moreover, the cooling roll in the manufacturing apparatus is made from a copper alloy and has a diameter of 1000 mmϕ and a width (length) of 400 mm, in which a roll surface is cooled with water. The molten metal injection nozzle for injecting the molten metal has a slit interval of 0.7 mm and a slit width of 200 mm.

In the manufacture of the metal thin strip, a rotation speed (peripheral speed) of the cooling roll is set to 21 m/s and a distance (gap) between the surface of the cooling roll and the tip of the molten metal injection nozzle is set to 0.25 mm. Moreover, the carbon dioxide gas injection nozzle is arranged just behind the airflow blocking device, whereby carbon dioxide gas is injected toward a portion of the airflow blocking device contacting with the surface of the cooling roll and along a surface at a downstream side of the airflow blocking device in the rotation direction of the roll.

In this case, the type and arranging position of the airflow blocking device and the foreign material removal device are changed as shown in Table 1 to examine a surface quality of a metal thin strip. Moreover, the surface quality of the metal thin strip is evaluated by a maximum value ($Ra_{max}$) of an average value obtained by measuring a surface roughness Ra (arithmetic mean roughness defined in JIS B0601 (1994)) in a surface of the metal thin strip contacting with the cooling roll after the continuous operation for 30 minutes at 10 places at an interval of 10 mm in the widthwise direction of the metal thin strip and determining an average value in each widthwise place.

The evaluation results of the surface quality are shown in Table 1 together with the manufacturing conditions. It can be seen from these results that the metal thin strips manufactured under conditions adapted to the invention have good $Ra_{max}$ of not more than 0.7 μm, whereas the metal thin strips manufactured under conditions not adapted to the invention have $Ra_{max}$ of not less than 1.0 μm. It has been confirmed from the results that the metal thin strips having an excellent surface quality can be manufactured stably by using the apparatus for manufacturing the metal thin strip according to the invention regardless of the continuous operation for a long time of 30 minutes.

TABLE 1

| | Airflow blocking device | | | | Foreign material removal device | | Surface roughness | |
|---|---|---|---|---|---|---|---|---|
| No | Type | Distance to surface of cooling roll (mm) | Distance to molten metal injection nozzle (mm) | Contact/ non-contact | Type | Distance to airflow blocking device (mm) | $Ra_{max}$ of metal thin strip at surface contacting with roll (μm) | Remarks |
| 1 | Carbon blade | Contact | 200 | Contact | Felt roll | 100 | 0.6 | Invention Example |
| 2 | Carbon blade | 0.05 | 150 | Contact | Brush made from aramid fibers | 200 | 0.6 | Invention Example |

TABLE 1-continued

| | Airflow blocking device | | | Foreign material removal device | | | Surface roughness | |
|---|---|---|---|---|---|---|---|---|
| No | Type | Distance to surface of cooling roll (mm) | Distance to molten metal injection nozzle (mm) | Contact/ non-contact | Type | Distance to airflow blocking device (mm) | $Ra_{max}$ of metal thin strip at surface contacting with roll (μm) | Remarks |
| 3 | Carbon blade | 0.5 | 100 | Non-contact | Rare-earth magnet | 200 | 0.7 | Invention Example |
| 4 | Brush made from aramid fibers | Contact | 300 | Non-contact | Gas jet (dry air) | 300 | 0.7 | Invention Example |
| 5 | Nonwoven cloth pad | Contact | 300 | Non-contact | Gas jet (carbon dioxide) | 300 | 0.6 | Invention Example |
| 6 | Fluorine resin block | 0.5 | 300 | Contact | Nonwoven cloth roll | 100 | 0.7 | Invention Example |
| 7 | Brush made from aramid fibers | Contact | 300 | Contact | Nonwoven cloth belt | 100 | 0.7 | Invention Example |
| 8 | Silicon rubber plate | 1.5 | 300 | Contact | Gauze roll | 100 | 0.7 | Invention Example |
| 9 | None | — | — | — | None | — | 1.2 | Comparative Example |
| 10 | Carbon blade | Contact | 300 | — | None | — | 1.0 | Comparative Example |
| 11 | Fluorine resin block | 2.2 | 300 | Contact | Felt roll | 100 | 1.2 | Comparative Example |
| 12 | Carbon blade | 2.5 | 300 | Contact | Felt roll | 100 | 1.1 | Comparative Example |
| 13 | Carbon blade | Contact | 350 | Contact | Felt roll | 100 | 1.5 | Comparative Example |
| 14 | Carbon blade | Contact | 200 | Contact | Felt roll | 700 | 1.5 | Comparative Example |

DESCRIPTION OF REFERENCE SYMBOLS

1: Molten metal injection nozzle
2: Cooling roll
3: Molten metal and thin strip
4: Airflow blocking device using carbon blade
5: Carbon dioxide gas injection nozzle
6: Flow of carbon dioxide gas
7: Rotation direction of cooling roll
8: Foreign material removal device using felt roll
9: Airflow blocking device using fluorine resin block
10: Foreign material removal device using rare-earth magnet
11: Airflow blocking device using brush made from aramid fibers
12: Foreign material removal device using doctor blade

The invention claimed is:

1. A single roll apparatus for manufacturing a metal thin strip by injecting a molten metal onto an outer peripheral face of a cooling roll rotating at a high speed and rapidly solidifying it to manufacture a metal thin strip, wherein an airflow blocking device for blocking the airflow along the surface of the cooling roll is provided at an upstream side of a molten metal injection nozzle for injecting the molten metal in a rotation direction of the cooling roll, a carbon dioxide gas injection nozzle for forming a flow of carbon dioxide gas on an outer peripheral surface of the cooling roll between the airflow blocking device and the molten metal injection nozzle or forming a carbon dioxide atmosphere on the surface of the cooling roll between the airflow blocking device and the molten metal injection nozzle is disposed, a foreign material removal device for removing foreign material attached to the surface of the cooling roll is disposed within a range of 600 mm at an upstream side in the rotation direction of the cooling roll with respect to the airflow blocking device, the foreign material removal device contacting with the surface of the cooling roll for removing foreign material, and the foreign material removal device is a gas injection device injecting a gas onto the surface of the cooling roll.

2. The apparatus for manufacturing a metal thin strip according to claim 1, wherein the airflow blocking device is disposed in contact with the surface of the cooling roll or at a gap of not more than 2 mm to the surface of the cooling roll.

3. The apparatus for manufacturing a metal thin strip according to claim 2, wherein the airflow blocking device is disposed within a range of 300 mm at the upstream side in the rotation direction of the cooling roll with respect to the molten metal injection nozzle for injecting the molten metal.

4. The apparatus for manufacturing a metal thin strip according to claim 2, wherein the airflow blocking device is made from a material softer than the surface of the cooling roll.

5. The apparatus for manufacturing a metal thin strip according to claim 3, wherein the airflow blocking device is made from a material softer than the surface of the cooling roll.

6. The apparatus for manufacturing a metal thin strip according to claim 3, wherein the carbon dioxide gas injection nozzle injects the carbon dioxide gas toward a portion of the airflow blocking device contacting with the surface of the cooling roll and along a surface at a downstream side of the airflow blocking device in the rotation direction of the cooling roll.

7. The apparatus for manufacturing a metal thin strip according to claim 3, wherein the carbon dioxide gas injection nozzle injects the carbon dioxide gas toward the surface of the cooling roll between the molten metal injection nozzle and the airflow blocking device.

8. The apparatus for manufacturing a metal thin strip according to claim 1, wherein the airflow blocking device is disposed within a range of 300 mm at the upstream side in the rotation direction of the cooling roll with respect to the molten metal injection nozzle for injecting the molten metal.

9. The apparatus for manufacturing a metal thin strip according to claim 8, wherein the airflow blocking device is made from a material softer than the surface of the cooling roll.

10. The apparatus for manufacturing a metal thin strip according to claim 1, wherein the airflow blocking device is made from a material softer than the surface of the cooling roll.

* * * * *